United States Patent [19]

Chmela

[11] Patent Number: 4,997,190

[45] Date of Patent: Mar. 5, 1991

[54] LAWN DART

[76] Inventor: John F. Chmela, 1106 Beechwood Drive, Mount Prospect, Ill. 60056

[21] Appl. No.: 457,869

[22] Filed: Dec. 27, 1989

[51] Int. Cl.[5] ..... A63B 65/02

[52] U.S. Cl. ..... 273/420

[58] Field of Search ..... 273/416, 417, 419–423; D21/203

[56] References Cited

U.S. PATENT DOCUMENTS

| | | | |
|---|---|---|---|
| D. 232,649 | 9/1974 | Carlson et al. | D21/203 |
| 2,354,790 | 8/1944 | Beck | 273/417 |
| 2,734,746 | 2/1956 | Sametz et al. | 273/417 |
| 3,784,199 | 1/1974 | Chmela | 273/420 X |
| 3,904,205 | 9/1975 | Robinson | 273/417 |
| 3,982,762 | 9/1976 | Milicic | 273/420 |
| 4,887,822 | 12/1989 | Tsai | 273/420 |

FOREIGN PATENT DOCUMENTS

| | | | |
|---|---|---|---|
| 824161 | 7/1949 | Fed. Rep. of Germany | 273/420 |
| 1542497 | 3/1979 | United Kingdom | 273/417 |

OTHER PUBLICATIONS

The Sporting Goods Dealer 4–1972, p. 18, Toss-'um.

*Primary Examiner*—Paul E. Shapiro

*Attorney, Agent, or Firm*—Robert E. Knechtel

[57] ABSTRACT

A lawn dart which is of a two-piece construction and is molded of plastic. One piece of the lawn dart comprises a shaft having a plurality of fins formed on it (three as illustrated) for guiding the lawn dart in flight, and a blunt end which is formed to snap-fit into a tip for the dart which forms the second piece thereof. The tip for the dart is generally cup-shaped, and the free edge thereof is generally scalloped so as to provide an attractive appearance to the lawn dart when the two pieces are assemblied. Preferably and advantageously the tip is formed such that the blunt end on the shaft will snap fit into it for assembly, and further is formed to receive a weight within it.

5 Claims, 1 Drawing Sheet

FIG. 1
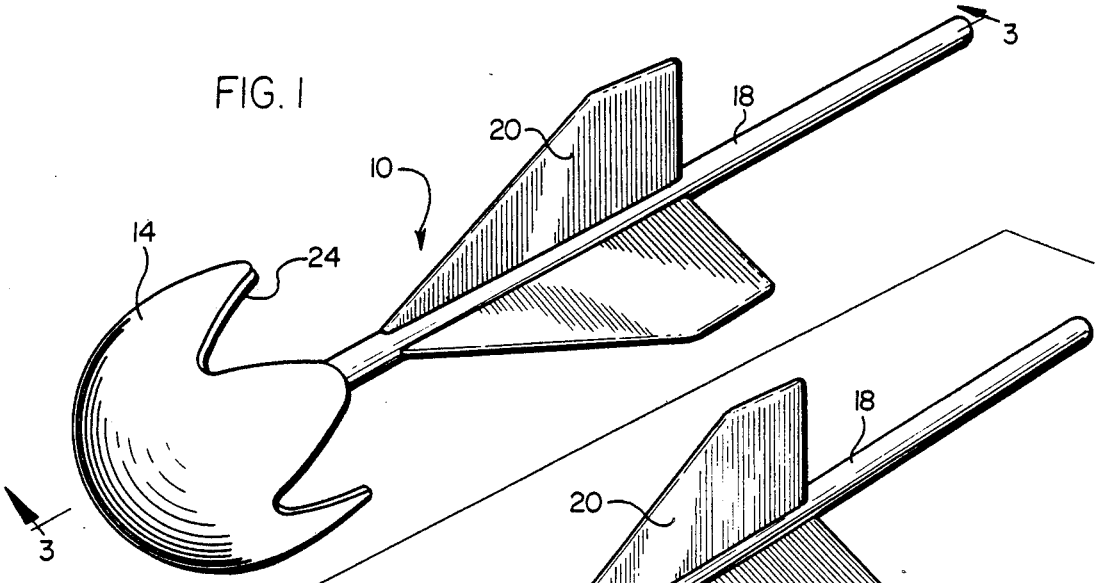
FIG. 2
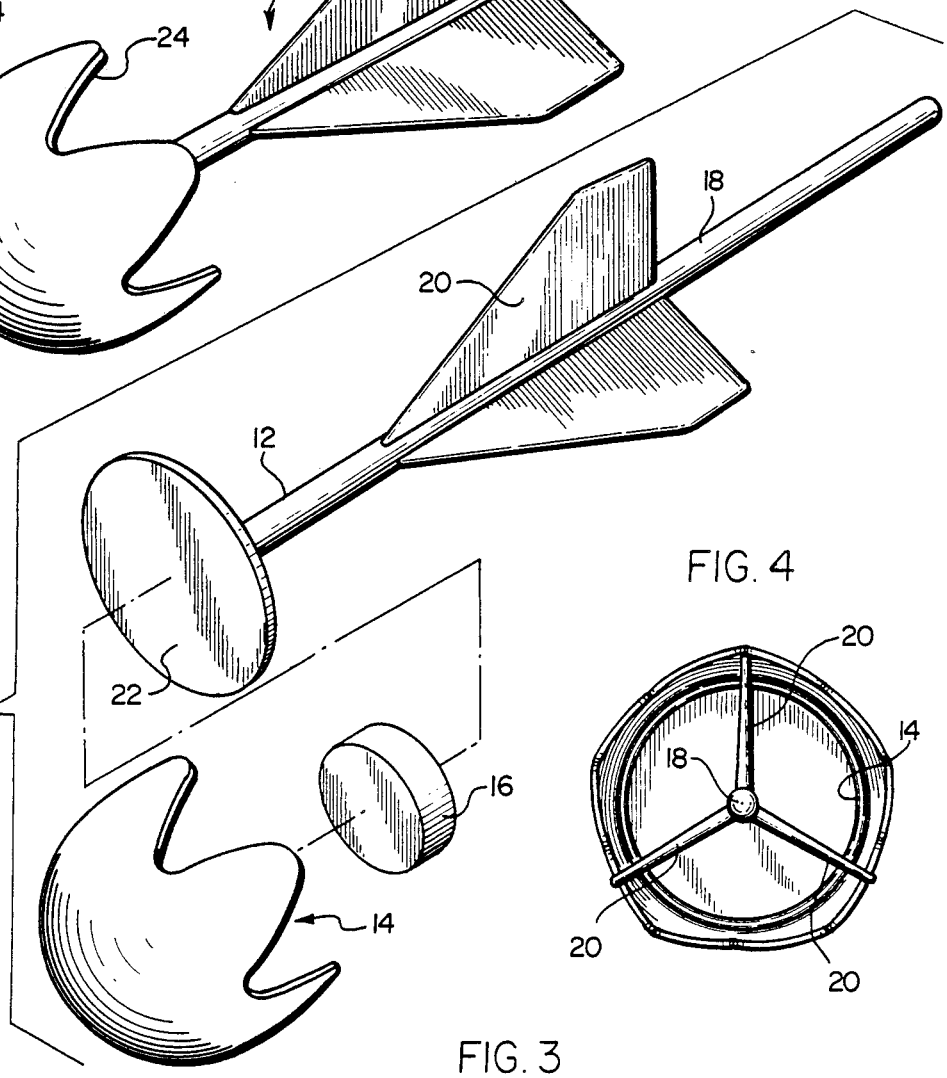
FIG. 4
FIG. 3
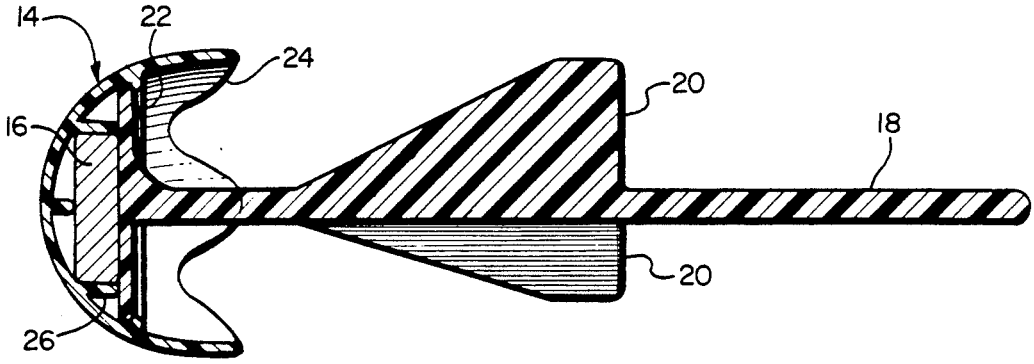

LAWN DART

This invention relates to an improved lawn dart. More particularly, it relates to an improved lawn dart which is of a construction such that a potential danger to the users thereof, or to others, is substantially, if not completely, eliminated.

Lawn darts are generally well known and, in the past, these lawn darts have generally included a tip which is intended to stick in the ground when the lawn dart is thrown at a target, usually a loop, lying on the ground. These types of lawn darts recently have been banned because of the danger to the users thereof and to others if they are struck by the flying dart. This is partically due to the fact that the tips of the lawn darts are usually of metal and are relatively sharp, and the lawn darts are quite heavy.

Accordingly, it is an object of the present invention to provide an improved lawn dart, one which can be played and has substantially the same characteristics as those which now have been banned, and which can be easily and inexpensively manufactured.

The above objective is accomplished with the lawn dart of the present invention which is of a two-piece construction and is molded of plastic. One piece of the lawn dart comprises a shaft having a plurality of fins formed on it (three as illustrated) for guiding the lawn dart in flight, and a blunt end which is formed to snap-fit into a tip for the dart which forms the second piece thereof. The tip for the dart is generally cup-shaped, and the free edge thereof is generally scalloped so as to provide an attractive appearance to the lawn dart when the two pieces are assembled. Preferably and advantageously the tip is formed such that the blunt end on the shaft will snap fit into it for assembly, and further is formed to receive a weight within it. The lawn dart including the weight is proportioned so that when the lawn dart is thrown and strikes the ground, it will rock or pivot so that the shaft thereof will project substantially vertical to the ground thus giving the appearance that the tip of the lawn dart is stuck in the ground. The lawn dart is essentially safe and will not cause any injury to a user or others because of the relatively large cup-shaped tip on it, as opposed to the long, relatively sharp tips on lawn darts of the past. With the fins on the shaft and the weight secured within the tip, the lawn dart has substantially the same flight characteristics of the prior lawn darts, and will stand upright on the ground so as to have generally the same appearance as a lawn dart of the prior construction when it is stuck in the ground.

The above objective as well as other objectives and features of the lawn dart of the invention will become apparent from the following description when taken in conjunction with the drawing wherein:

FIG. 1 is a side perspective view of a lawn dart exemplary of the invention;

FIG. 2 is an exploded perspective view of the lawn dart of FIG. 1;

FIG. 3 is a sectional view of the lawn dart of FIG. 1 taken along lines 3—3 thereof; and FIG. 4 is an end view of the lawn dart of FIG. 1.

Referring now to the drawing, in FIG. 1 there is shown a lawn dart 10 exemplary of the invention comprising a shaft portion 12 and a tip portion 14. Preferably and advantageously the lawn dart 10 also includes a weight 16 which is secured between the shaft portion 12 and the tip portion 14, as more particularly described below.

The shaft portion 12 is molded of plastic as an integral unit and includes a shaft 18, a plurality (three as illustrated) fins 20, and a blunt end 22 which is generally a flat, circular-shaped disc.

The tip portion 14 is a generally cup-shaped member which is molded of plastic, and the free edge 24 thereof preferably and advantageously is scalloped to provide an attractive appearance to the lawn dart 10. Interiorally, the tip portion 14 has a circular-shaped flange 26 which forms a pocket for receiving therein the weight 16. The tip portion 14 also has a circular-shaped flange 28 which forms a shoulder that is proportioned with respect to the blunt end 22 of the shaft portion 12 such that the blunt end 22 can be snap-fitted into the tip portion 14 to secure the latter and the shaft portion 12 together. In this respect, the height of the flange 26, the size of the weight 16 and the position of the flange 28 are all such that the weight 16 is securely contained within the pocket formed by the flange 26 when the shaft portion 12 and the tip portion 14 are affixed together. The tip portion 14 also may be provided with a post 30 which is proportioned to abut the weight 16 when it is seated. This post 30 prevents the end of the tip portion 14 from cracking if the lawn dart 10 is thrown in the air and lands on its tip on a hard surface.

From the above description it can be seen that the lawn dart 10 is essentially safe and will not cause injury to a user or other if they are hit by the thrown dart since it has a relatively large, blunt end as opposed to a relatively pointed tip as with prior lawn darts. Also, the lawn dart 10 can be easily and inexpensively molded of plastic, and can be assembled simply by inserting the weight 16 into the pocket formed by the flange 26 and then snap-fitting the shaft portion 12 and the tip portion 14 together. The shaft portion 12 and the tip portion 14 each can be molded of a different color plastic so that the appearance of the lawn dart 10 is enhanced. The lawn dart 10, with the fins 20 on the shaft 18 and the weight 16 secured therein between the tip portion 14 and the shaft portion 12, has substantially the same flight characteristics as the prior lawn darts when it is thrown through the air and it will stand upright on the ground so as to have the same appearance as the prior lawn darts when it is stuck in the ground.

What is claimed is:

1. A lawn dart comprising a shaft portion having a shaft, a plurality of fins on said shaft, and a circular-shaped blunt end on one end of said shaft; and a tip portion which is generally cup-shaped and which has a flange therein for forming a shoulder behind which said blunt end on said one end of said shaft can be snap-fitted to secure said shaft portion and said tip portion together.

2. The lawn dart of claim 1 further comprising a weight, a pocket within said tip portion for receiving therein said weight, said weight being securely retained within said pocket when said tip portion and said shaft portion are snap-fitted together to form said lawn dart.

3. The lawn dart of claim 2 wherein said tip portion has a free edge which is scalloped so as to provide an attractive appearance to said lawn dart.

4. The lawn dart of claim 2 wherein said tip portion and said shaft portion each is molded of a different color plastic material.

5. The lawn dart of claim 2 wherein said tip portion further has a post integrally formed therein which abuts against said weight when said tip portion and said shaft portion are snap-fitted together, said post preventing said tip portion from being cracked when thrown in the air and landing on the end of the tip portion on a hard surface.

* * * * *